US007576276B2

(12) United States Patent
Hallerberg

(10) Patent No.: US 7,576,276 B2
(45) Date of Patent: Aug. 18, 2009

(54) PERCUSSION INSTRUMENT SPINNER

(76) Inventor: Dale A. Hallerberg, 15 Old Barrington Rd., Lake Barrington, IL (US) 60010

( * ) Notice: Subject to any disclaimer, the term of this patent is extended or adjusted under 35 U.S.C. 154(b) by 0 days.

(21) Appl. No.: 12/218,199

(22) Filed: Jul. 11, 2008

(65) Prior Publication Data

US 2009/0165630 A1 Jul. 2, 2009

Related U.S. Application Data

(60) Provisional application No. 61/009,576, filed on Dec. 31, 2007.

(51) Int. Cl.
*G10D 13/02* (2006.01)

(52) U.S. Cl. ..... 84/421; 84/411 R; 224/265

(58) Field of Classification Search ..... 84/421, 84/411 R; 224/265
See application file for complete search history.

(56) References Cited

U.S. PATENT DOCUMENTS

| | | | | | |
|---|---|---|---|---|---|
| 1,130,689 | A | | 3/1915 | Atkinson | |
| 1,179,063 | A | | 4/1916 | Aldrete | |
| 2,854,880 | A | * | 10/1958 | Waters | 84/421 |
| 2,990,745 | A | * | 7/1961 | Casavant | 84/421 |
| 3,106,123 | A | * | 10/1963 | Johannsen | 84/421 |
| 4,387,839 | A | | 6/1983 | Dranchak | |
| 4,448,105 | A | * | 5/1984 | Cordes | 84/413 |
| 4,635,894 | A | * | 1/1987 | Sammons | 248/558 |
| 4,799,610 | A | | 1/1989 | Hsieh | |
| 4,946,127 | A | * | 8/1990 | Kulaga | 248/551 |
| 5,149,043 | A | * | 9/1992 | Grundmann | 248/349.1 |
| D345,473 | S | * | 3/1994 | Grundmann | D6/455 |
| 5,507,584 | A | * | 4/1996 | Sassmannshausen et al. | 403/78 |
| 5,546,841 | A | * | 8/1996 | Chen | 84/411 R |
| 5,573,158 | A | * | 11/1996 | Penn | 224/265 |
| 5,691,492 | A | | 11/1997 | May | |
| 6,075,190 | A | * | 6/2000 | Mosser et al. | 84/421 |
| 6,095,476 | A | * | 8/2000 | Mathis | 248/422 |
| 6,563,035 | B2 | * | 5/2003 | Hsieh | 84/327 |
| 6,653,540 | B2 | * | 11/2003 | Izen et al. | 84/421 |
| 7,071,401 | B2 | | 7/2006 | May | |
| 7,087,825 | B2 | * | 8/2006 | Izen et al. | 84/411 R |
| 7,166,790 | B2 | * | 1/2007 | May | 84/421 |
| 7,276,653 | B2 | * | 10/2007 | Shimada | 84/421 |
| 7,381,876 | B2 | * | 6/2008 | Miyajima | 84/421 |
| 7,481,410 | B2 | * | 1/2009 | Umberg | 248/551 |

* cited by examiner

*Primary Examiner*—Jeffrey Donels
*Assistant Examiner*—Robert W Horn
(74) *Attorney, Agent, or Firm*—Meroni & Meroni, P.C.; Charles F. Meroni, Jr.; Christopher J. Scott

(57) ABSTRACT

A percussion instrument spinner comprises a mounting structure having an integral swivel allowing the drum or instrument to rotate. The design is especially suited to marching bass drums. The spinner includes a locking mechanism in order to position the instrument's rotated position and fix it from further rotation. The spinner also includes two eyebolt-type mounts to allow it to be easily placed on a carrier, and two support bars which perform dual functions: 1) Holding the instrument at the proper height for the player, and 2) Supporting the instrument in a stable manner when the instrument is placed on the ground, with the edge of the instrument held off the ground to allow the heads to vibrate freely. The drum or percussion instrument with spinner is easily and removably attached to a carrier which the performer wears on their body in order to be able to move about and/or march while playing.

20 Claims, 7 Drawing Sheets

PERCUSSION INSTRUMENT SPINNER

PRIOR HISTORY

This application claims the benefit of U.S. Provisional Patent Application No. 61/009,576, filed in the United States Patent and Trademark Office on Dec. 31, 2007.

BACKGROUND OF THE INVENTION

1. Field of the Invention

This invention relates to new and useful improvements in percussion carrier apparatus having the capability to spin the instrument or drum. More particularly, the present invention relates to the construction and mounting of the swivel mechanism between the carrier harness and a marching bass drum.

2. Description of Prior Art

U.S. Pat. No. 1,130,689, which issued to Atkinson and U.S. Pat. No. 1,179,063, which issued to Aldrete disclose certain body supported carrying devices. The carrying devices rely on supports which are looped over the neck and cross the shoulder. Applying this concept to percussion instrument carriers for marching drums, U.S. Pat. No. 2,854,880, which issued to Walters, discloses a drum carrier for spinner drum. While this patent discloses a carrier for a spinning drum, it does not disclose that the swivel mechanism has a spring-loaded locking mechanism which allows the drum to be locked in place at various rotation angles.

This patent does not disclose a swivel mechanism wherein the two support bars include axial mounting holes which accept support rods from the drum carrier harness, allowing the carrier to be worn under a conventional performer's uniform without altering the uniform. This patent does not disclose a swivel mechanism that allows the drum to be easily attached or removed from the carrier. This patent does not disclose a swivel mechanism that allows the drum to be placed on the floor with side support in order to allow the drum to resonate freely in a quasi-horizontal position. This patent does not disclose a swivel mechanism which has a bearing width which is at least 10 times its thickness, which serves to provide a robust bearing design for longer life.

U.S. Pat. No. 5,573,158, which issued to Penn, discloses a spinning drum carrier. While this patent discloses a spinning drum carrier, it does not disclose that the swivel mechanism has a spring-loaded locking mechanism which allows the drum to be locked in place at various rotation angles. This patent does not disclose a swivel mechanism wherein the two support bars include axial mounting holes which accept support rods from the drum carrier harness, allowing the carrier to be worn under a conventional performer's uniform without altering the uniform. This patent does not disclose a swivel mechanism that allows the drum to be easily attached or removed from the carrier. This patent does not disclose a swivel mechanism that allows the drum to be placed on the floor with side support in order to allow the drum to resonate freely in a quasi-horizontal position. This patent does not disclose a swivel mechanism which has a bearing width which is at least 10 times its thickness, which serves to provide a robust bearing design for longer life.

U.S. Pat. No. 4,799,610, which issued to Hsieh and U.S. Pat. No. 5,691,492, which issued to May disclose certain carrier assemblies for percussion instruments having a pair of "J-bars' which extend from the belly-plate of the carrier to supports mounted on the drum. These patents and other prior art do not disclose supports mounted on the drum which extend vertically to support a bass drum in order to allow the carrier to be worn under a conventional performer's uniform.

Other prior art of interest and pertinent to the present invention include U.S. Pat. No. 3,106,123, which issued to Johannsen; U.S. Pat. No. 4,387,839, which issued to Dranchak; U.S. Pat. No. 7,071,401, which issued to May; and U.S. Pat. No. 7,276,653, which issued to Shimada.

Various prior inventions have been disclosed that provide a percussion instrument carrier which allows the drum to spin, but none of the listed inventions provide the claims above. The ideal invention would provide a support mechanism that allows the drum to spin, allows the drum to quickly hold in place at various rotational positions, allows the drum to be easily mounted to or removed from the carrier, allows the drum carrier to be worn underneath a conventional performer's uniform, and allows the drum to be placed on the floor with side support in order to allow the drum to resonate freely in a quasi-horizontal position. The ideal invention would also mount stably to existing drum designs. The design of the spinner should also be robust and minimize stresses in order to have a long useful life. The proposed invention provides these features.

SUMMARY OF THE INVENTION

Accordingly, one of the objects of this invention is to allow the drum to spin while worn by the user. The spinning should be smooth and low-friction.

Another object of this invention is to provide a mechanism so that the drum may lock in place at various rotational positions such as vertically, horizontally, and at an intermediate angle, in order to achieve visual consistency between several instruments and so that the drum does not spin until desired. The locking mechanism should have an easily-accessed spring-loaded release for quick release and quick catch at the chosen rotation position. The shape of the locking mechanism should allow for a firm locking stop without rattling when the drum is in the vertical position, while the other rotated positions may use a detent which holds the drum gently in position.

Another object of this invention is to allow the drum to be quickly and easily mounted on the carrier or removed from the carrier.

Another object of this invention is to be completely compatable with existing carriers.

Another object of this invention is to provide a means for the drum to be placed on the floor or ground with side support in order to elevate the rim of the drum. This allows the drum to resonate freely in a quasi-horizontal position.

Another object of the invention is to provide a means for the drum carrier to be worn underneath a conventional performer's uniform.

Another object of the invention is to provide a means for the spinner to be stably mounted to existing drums, of either the conventional design or drum designs that utilize outside-threaded lug-casing inserts tightened into the drum's lug-casings.

Various objects, features, aspects, and advantages of the present invention will become more apparent from the following detailed description of preferred embodiments of the invention, along with the accompanying drawings in which like numerals represent like components.

BRIEF DESCRIPTION OF THE DRAWINGS

Other features of my invention will become more evident from a consideration of the following brief description of patent drawings:

FIG. 9(*a*) is a fragmentary depiction of the percussion instrument spinner locking mechanism showing a rotation-detent stop.

DETAILED DESCRIPTION OF THE PREFERRED EMBODIMENT

Figure 1:
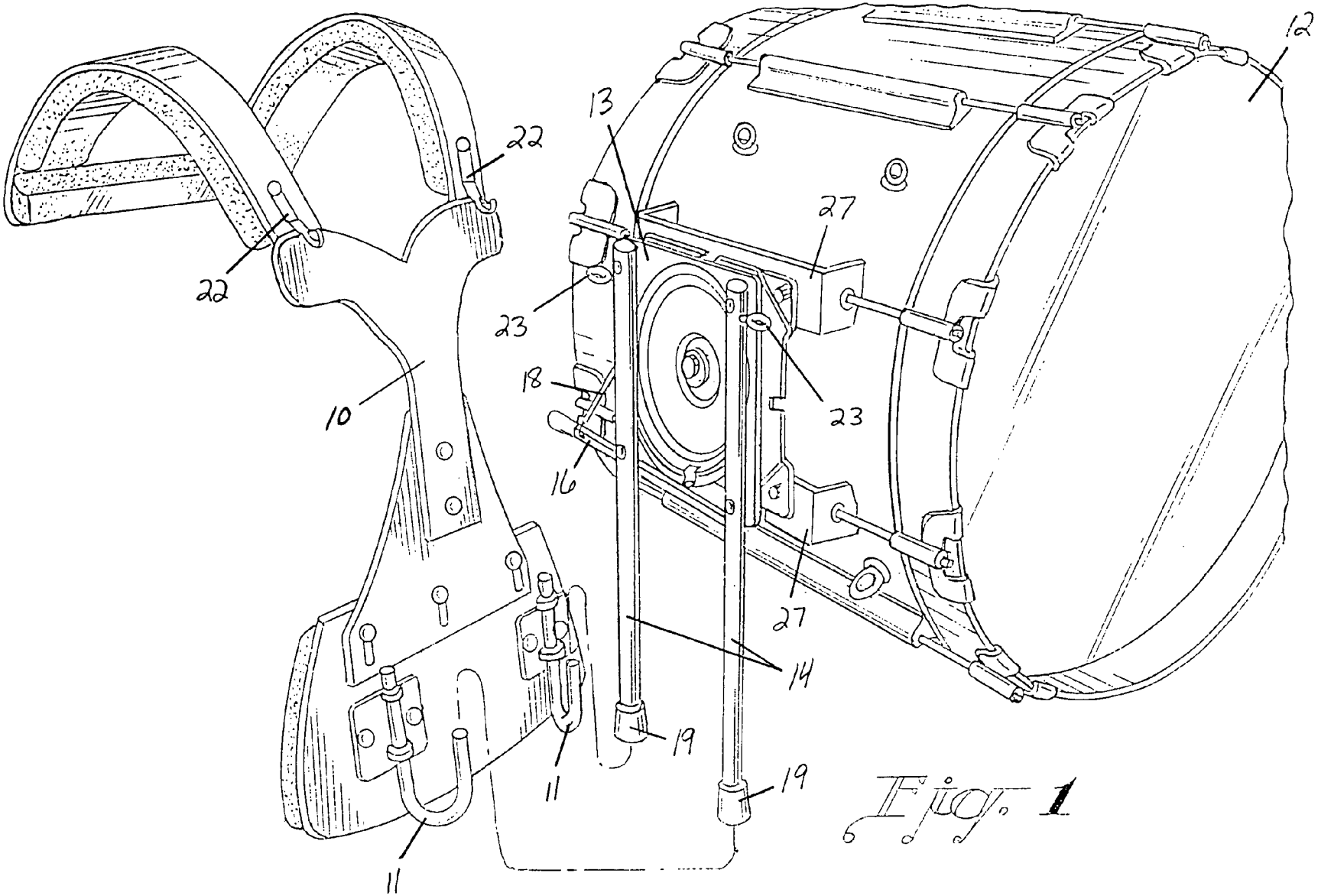
FIG. 1 is a perspective view of a drum carrier and drum assembly juxtaposed one another. The drum assembly essentially comprises a bass drum and a percussion instrument spinner mounted to the bass drum.

Referring to FIG. 1, there is shown a carrier harness 10 for percussion instruments that includes laterally opposed J-shaped support rods 11 adjacent the harness's inferior end. The construction of the carrier harness or carrier 10 is shown as a T-bar type construction, but the carrier 10 can be any configuration including but not limited to, T-bar, tubular, vest, or hybrid combination of these types of construction.

A drum 12 (such as a bass drum) is affixed to the swivel assembly or swivel mechanism 13. The swivel mechanism 13 in its preferred embodiment is constructed with a state of the art turntable-type bearing, where the ball bearings are held in a circular groove stamped into the front and back halves of the swivel mechanism 13. The ball bearings are held separate from one another by the use of a bearing race. The front and back halves of the swivel mechanism 13 are held together with a heavy gauge rivet, or alternatively a center bolt which cannot loosen, typically by using a castle nut with a cotter pin through the bolt.

The portion of the swivel mechanism 13 away from the drum 12 has two laterally opposed support bars 14 attached. The length of the support bars 14 is chosen specifically so that when the swivel mechanism 13 may be rotated to place the drum playing surface substantially parallel to the ground. In this last regard, it should be noted that when the drum 12 is placed on the ground as attached to the swivel mechanism, there will be space between the ground and the supported rim of the drum 12 as at 100 in FIG. 7. This space is 2-6 in. (5-15 cm) in the preferred embodiment. This space allows the drum heads to vibrate freely and obtain a fuller, more resonant and pleasant tone.

Figure 2:
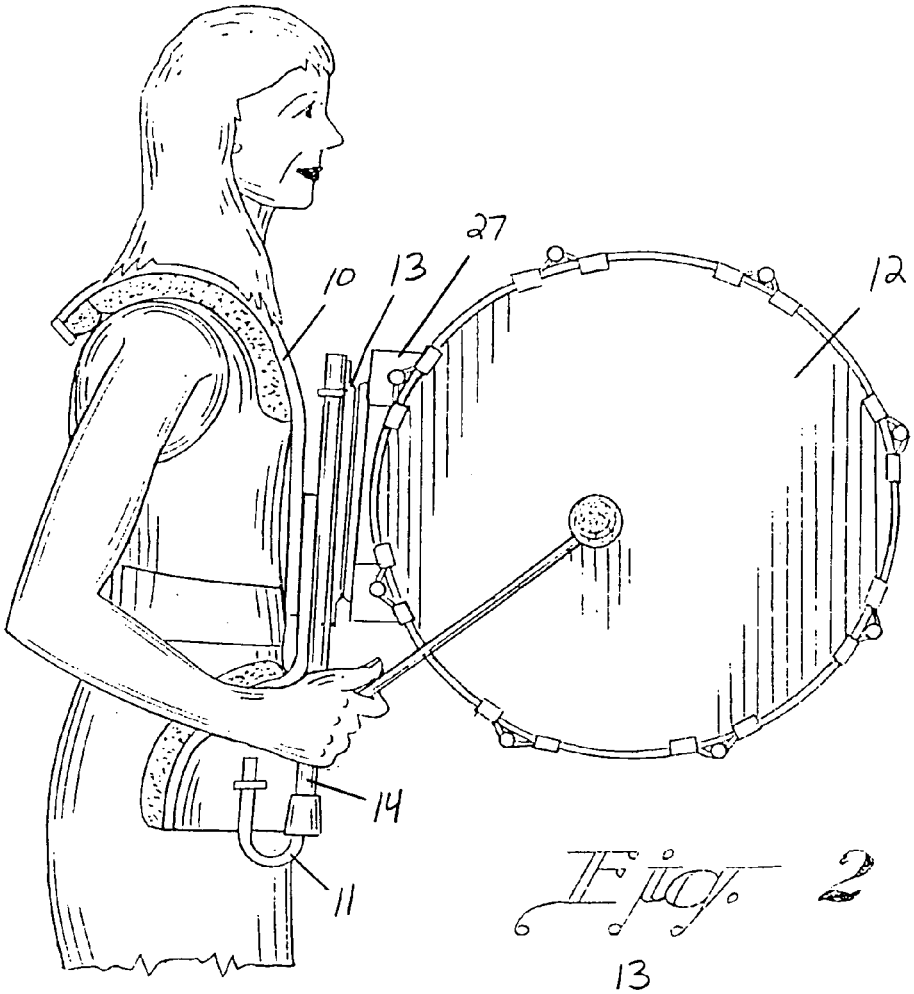
FIG. 2 is a fragmentary side view of a user donning a drum carrier, the drum assembly according to the present invention being mounted to the drum carrier and oriented in a conventional playing position.

Referring to FIG. 2, the normal playing position for the drum 12 is attained when the carrier 10 is placed on the shoulders of the performer as generally depicted, and the drum 12 as outfitted with the swivel mechanism 13 is mounted to the carrier 10. In this position, and in this figure, the support bars 14 are mounted upon the support rods 11. This structural arrangement allows room for the performer to wear their uniform or costume over the top of the drum carrier 10. Although not specifically illustrated, the rods 11, may emerge from the bottom of the uniform and function to mate with the bars 14.

Figure 3:
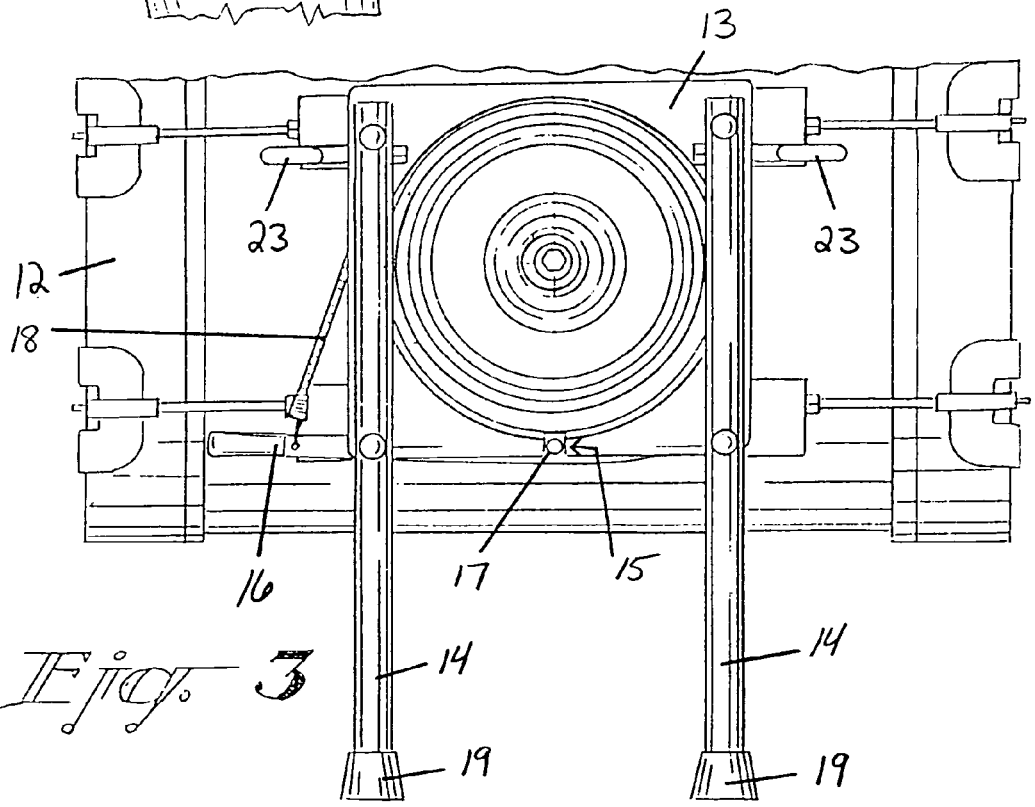
FIG. 3 is a front plan view of the percussion instrument spinner mounted to a fragmentary bass drum.

Referring to FIG. 3, the swivel mechanism 13 includes at least one, but preferably a multiplicity of locking stops 15 and a spring-loaded lever 16 with a key 17. The spring 18 on the lever 16 acts to pull the key 17 into the locking stop 15 and hold the drum 12 in rotational position. When the spring-loaded lever 16 is rotated away from a select stop 15 of the swivel mechanism 13, the swivel mechanism 13 may spin freely. The two support bars 14 are connected to the outside half portion of the swivel mechanism 13, which portion is away from the drum 12.

The preferred construction of the support bars 14 is steel pipe with an inside diameter just larger than the outside diameter of the carrier support rods 11. The feet 19 of the bars 14 extend past the end of the support bars 14 to provide cushioning. The feet 19 have axial holes to allow the carrier support rods 11 to pass through. In this last regard, the reader is directed to FIG. 10. The support bars 14 have an axial hole 20 which accepts the support rods 11. A stop 21 is installed within the bars 14 to block the support rod 11 from being inserted to the point where is might jam due to the curvature of the support bar 11. Thus the drum assembly (i.e. swivel mechanism 13 and drum 12) may be easily disengaged from the carrier 10.

Figure 4:
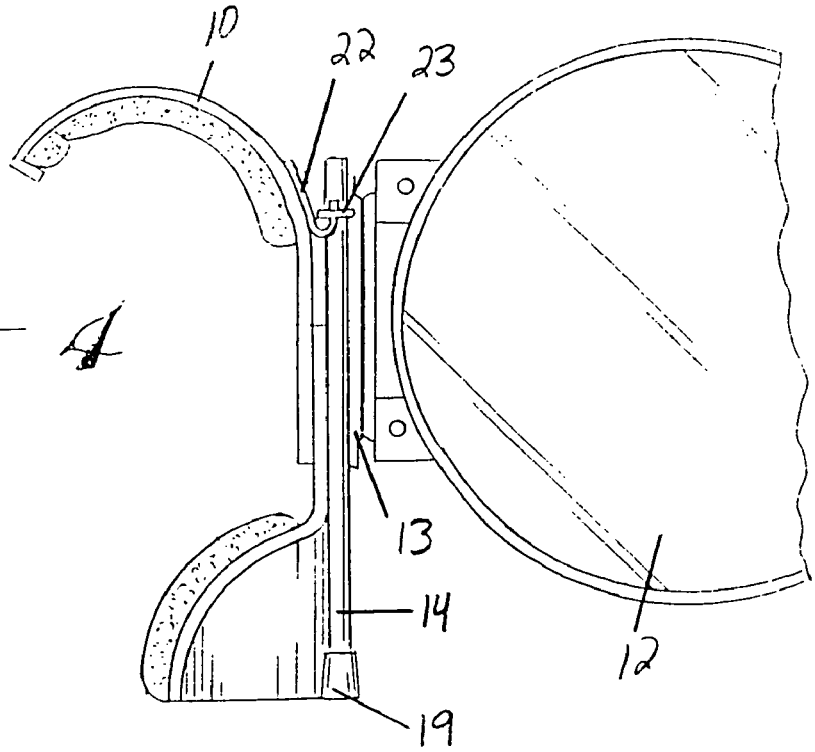
FIG. 4 is a side view depiction of the drum carrier and drum assembly attached thereto by way of upper shoulder hooks.
Figure 5:
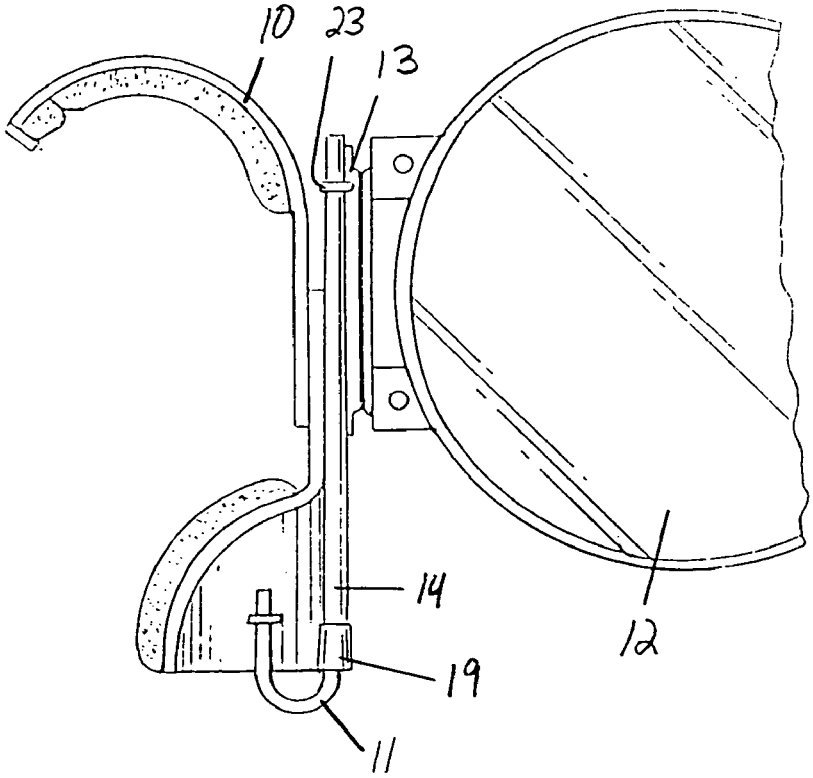
FIG. 5 is a side view depiction of the drum carrier and drum assembly attached thereto by way of lower J-bars.

The invention also provides a second option for mounting the drum assembly to drum carriers in circumstances when the performer chooses to use a conventional drum carrier with shoulder hooks 22 rather than the support rods 11 as generally depicted in FIG. 4. (Support rod 11 mounting is generally depicted in FIG. 5 and presented directly beneath FIG. 4 for ease of comparison). It is contemplated that the support bars 14 may preferably comprise eyebolts 23. The eyebolts 23 extend away from the centerline of the swivel mechanism 13 as generally depicted in FIG. 3. These eyebolts 23 are normally at the top end of the support bars 14, but in some cases may be placed at various heights on the support bars 14. The support bars 14 may be provided with several sets of eyebolt mounting holes at varying heights to accommodate the needs of various performers.

Figure 6:
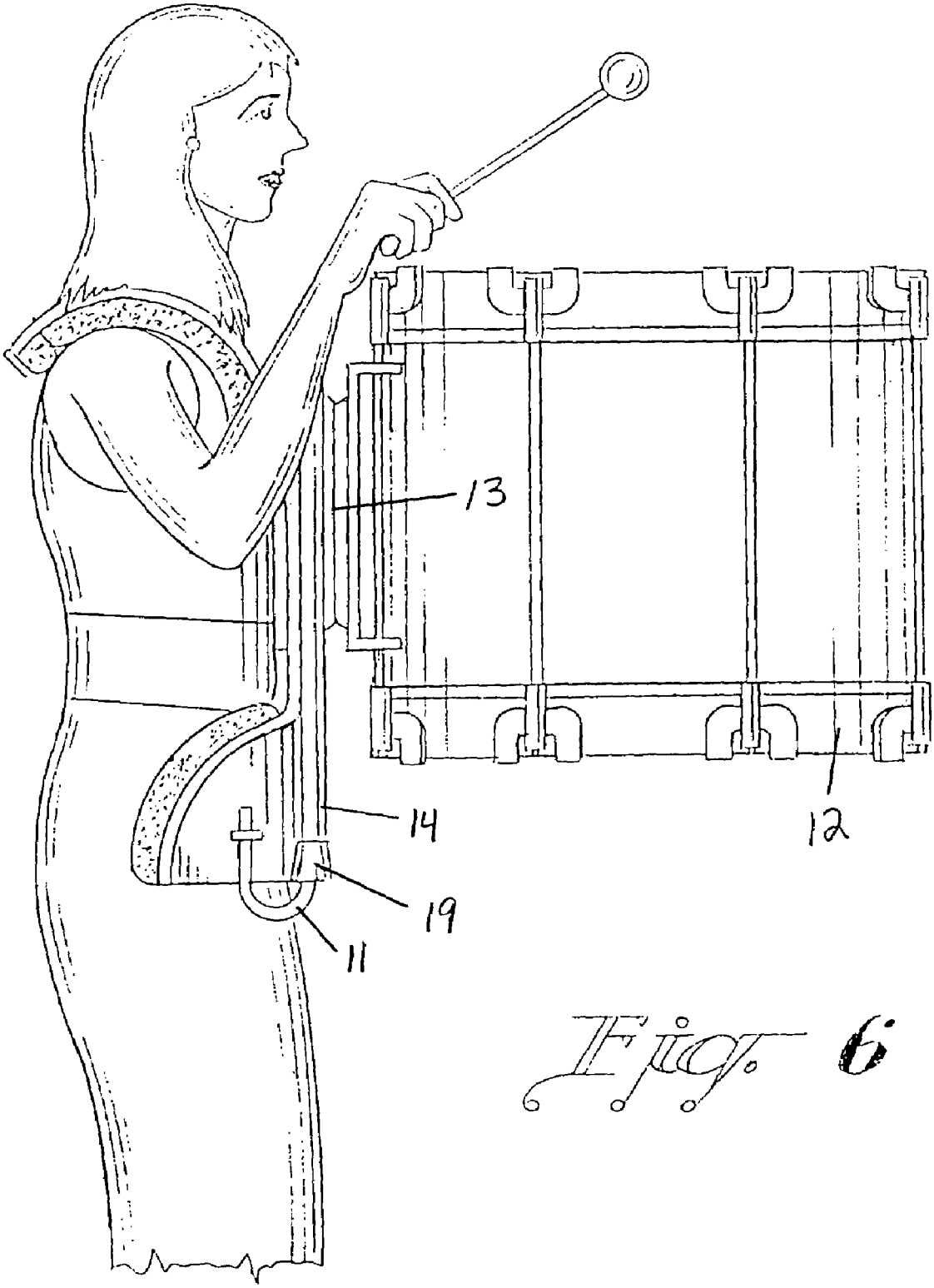
FIG. 6 is a fragmentary side view of a user donning a drum carrier, the drum assembly according to the present invention being mounted to the drum carrier and oriented in a horizontal playing position.
Figure 7:
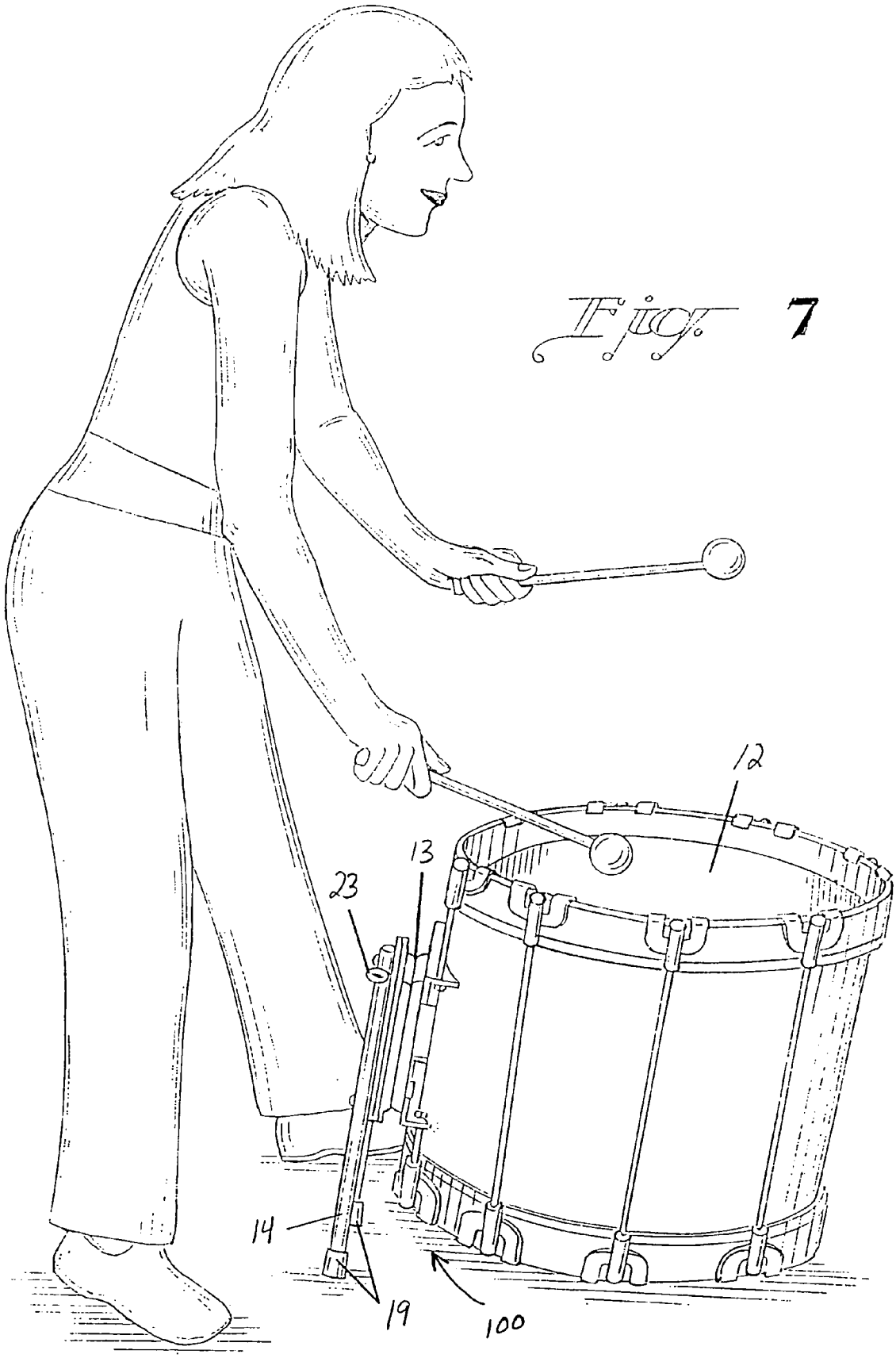
FIG. 7 is a depiction of a user adjacent the percussion instrument spinner and bass drum in a quasi-horizontal floor playing position.

Referring now to FIG. 6, the horizontal playing position for the drum 12 is attained when the spring-loaded lever 16 is depressed, and the drum 12 is rotated 90°. The spring-loaded lever 16 may then be released, and the drum 12 may be held in a select rotation position by way of the key 17 and a select stop 15 as previously specified. Referring to FIG. 7, the floor playing position for the drum 12 is attained when the drum 12 is rotated 90° and so held in place.

In this last regard, the drum assembly may be disengaged from the support rods 11 or the drum carrier shoulder hooks 22, and the drum 12 placed on the floor so that the support bars 14 hold one edge of the drum 12 off the floor. This allows the drum head to vibrate freely, resulting in a full sound. The feet 19 extend past the end of the support bars 14 to provide cushioning so that the support bars 14 do not damage the floor.

Figure 8:
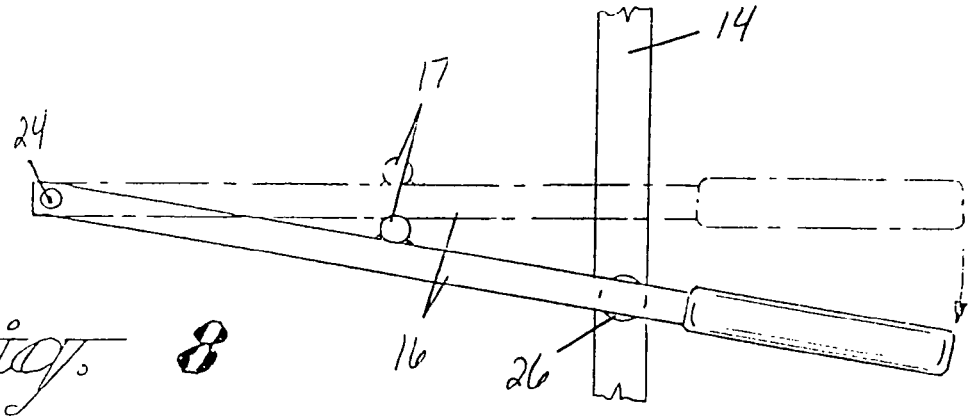
FIG. 8 is a depiction of the percussion instrument spinner magnetic latch for the locking release arm.
Figure 9:
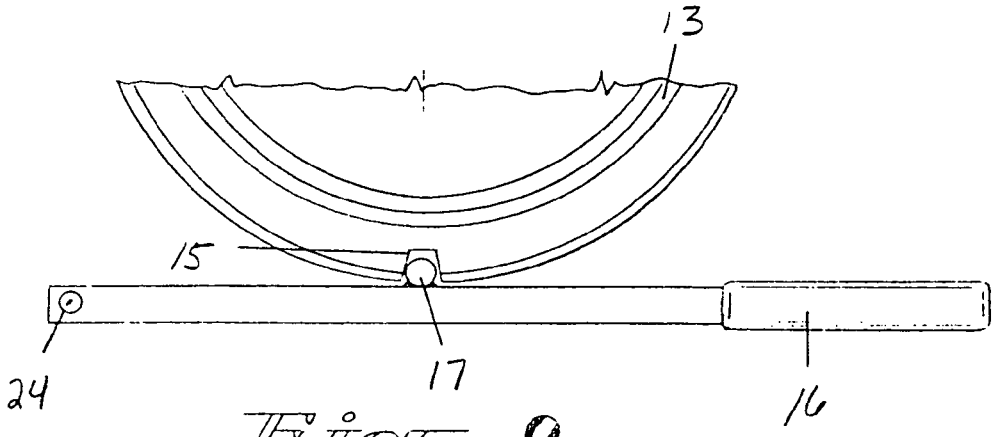
FIG. 9 is a fragmentary depiction of the percussion instrument spinner locking mechanism showing a rotation-locking stop.
Figure 9A:
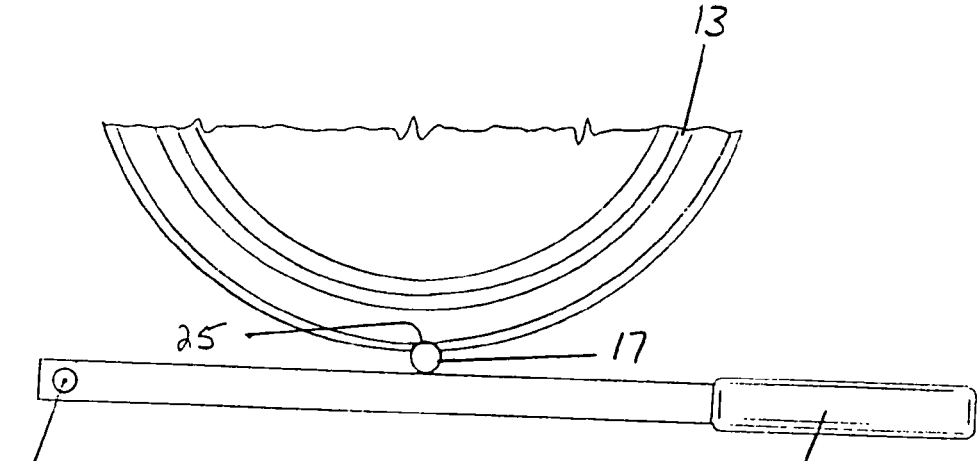

Referring to FIGS. 8-9(*a*), and as previously introduced, the swivel mechanism 13 includes a spring-loaded lever 16 with a key 17. The spring-loaded lever 16 rotates about a pivot 24. The spring 18 on the lever 16 acts to pull the key 17 into the locking stop 15 and hold the drum 12 in rotational position. The locking stop 15 is preferably keystone shaped (trapezoidal) in order to firmly lock the rotation of the swivel mechanism 13 and eliminate rattling of the mechanism.

In other locations on the circumference of the swivel mechanism 13, rounded detents 25 are provided which have a depth of less than half the diameter of the key 17. These detents 25 hold the key 17 gently in place, but do not totally lock the rotation of the swivel mechanism 13. The performer may rotate the drum out of the detent 25 by pushing on the drum 12 without operating the spring-loaded lever 16. In this regard, it is contemplated that the detents 25 function to temporarily hold the drum in a select rotational position.

Referring to FIG. 8, one support bar 14 has a magnet 26 mounted below the resting position of the spring-loaded lever 16. The preferred embodiment is a high-strength magnet of a disc shape with a center mounting hole. The performer may choose to push the spring-loaded lever 16 down past the release point in order to engage the magnet 26 and hold the spring-loaded lever 16 in the "open" position. The spring-loaded lever 16 is released from the magnet 26 by a push from the performer.

Figure 10:
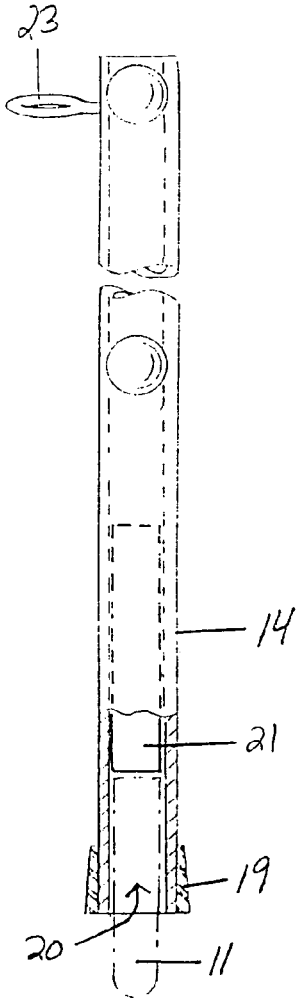
FIG. 10 is a cutaway view of a support bar of the percussion instrument spinner.
Figure 11:
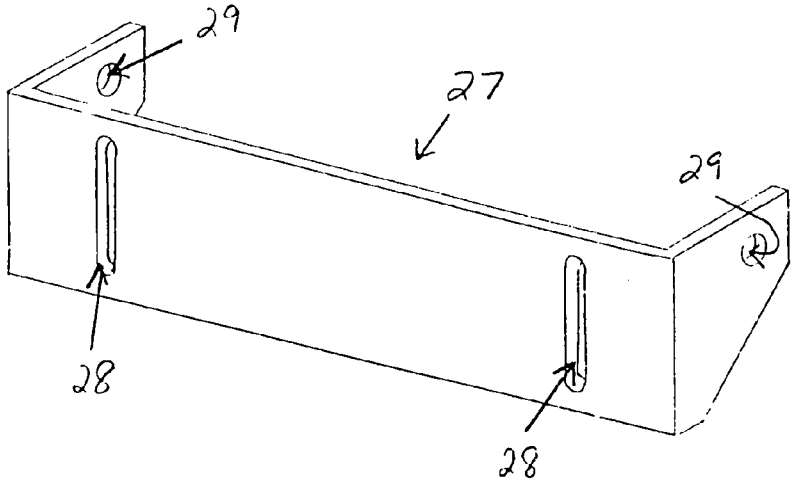
FIG. 11 is a perspective view of a bracket for mounting the percussion instrument spinner to a bass drum.
Figure 12:
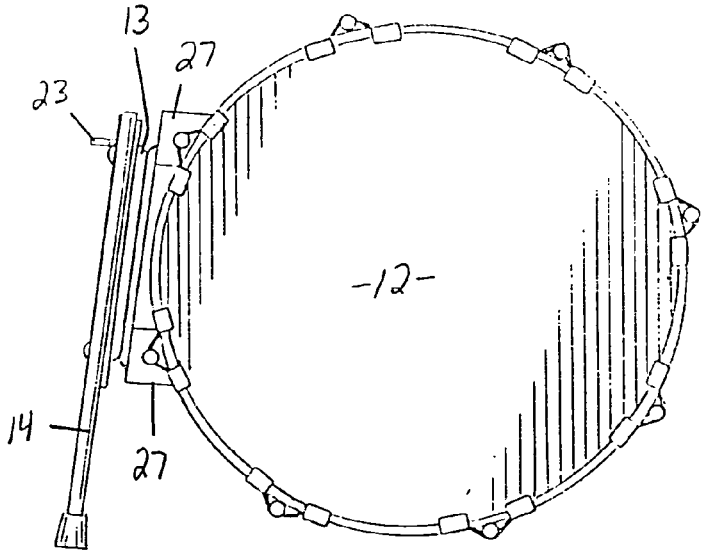
FIG. 12 is a side view of the percussion instrument spinner attached to a bass drum.

Referring to FIG. 10, the swivel mechanism 13 may be mounted to drum designs that utilize outside-threaded lug-casing inserts tightened into the drum's lug-casings by using two mounting plates 27. The swivel mechanism 13 is bolted to the mounting plate 27 through the slots 28, which allow freedom of positioning for various sizes of drum and various spacings between lug casings. The mounting plate 27 is fixed to the drum by tightening the outside-threaded lug-casing inserts through the side holes 29 into the lug-casing. Other drum mounting means may effectively function to attach the swivel mechanism to drums of various types. For example, it is contemplated that standoff's may effectively be bolted through the drum shell of conventional drums.

While the above description contains much specificity, this specificity should not be construed as limiting the scope of the invention, but rather as an exemplification of the invention. For example, it is contemplated that the present invention essentially describes and teaches a swivel assembly or mechanism for use in combination with a drum to effect drum rotation. The swivel assembly according to the present invention comprises certain drum mounting means for mounting the swivel assembly 13 to a drum 12. It is contemplated that the drum mounting means may be defined by the mounting plate(s) 27, but may be defined by various structures so long as the swivel mechanism is firmly mounted to the drum 12.

Further, the swivel assembly 13 comprises certain spring-actuable means operating in tandem with locking stops 15 for enabling a user to selectively position the drum 12 in a rotational position and prevent further drum rotation. The spring-loaded locking stops 15 of the swivel assembly 15 may comprise first and second stop structures. The first stop structure (such as stops 15) may well function to lock the drum 12 in a first position (such as a vertical position), and the second stop structure (such as detents 25) may well function to temporarily hold the drum 12 in a second position (such as a horizontal position). In this regard, the stops may comprise keystone-shaped structure as at 15 for preventing drum movement or rounded detent structure as at 25 for temporarily holding the drum in a select position. The locking release arm or lever 16 is cooperable with the locking stops and may further comprise a magnetic latch for retaining the lever 16 in an open position.

The swivel assembly 13 may further comprise opposed vertical support bars 14, which bars 14 have sufficient length to support the drum 12 with one edge thereof raised when the drum 12 is placed on a horizontal surface as generally depicted in FIG. 7. The vertical support bars 14 may further comprise eyehooks 23, which are preferably attached to the vertical support bars 14 at the upper end thereof to allow easy mounting to a variety of bass drum carriers. The lower ends of the bars 14 comprise axial mounting holes 20 for accepting support rods (as at 11) of a drum carrier 10.

The swivel assembly 13 is preferably constructed with a turntable-type bearing, which bearing has a bearing diameter as generally depicted in FIG. 3 and a bearing thickness as generally depicted in FIGS. 2, 4, 5, 6 and 12. From a comparative inspection of the noted figures, it may be readily understood that in order to provide a robust bearing structure the bearing diameter may be at least 10 times the bearing thickness. The bearing provides the interface between the bars 14 and the drum 12, and thus should be constructed so as to provide load-bearing function or quality as well as rotational movement sufficient to rotatably support a base drum or similar other percussion instrument.

Thus, specific embodiments and applications for a percussion equipment spinner have been disclosed. It should be apparent, however, to those skilled in the art that many more modifications besides those described are possible without departing from the inventive concepts herein. The inventive subject matter, therefore, is not to be restricted except in the spirit of the appended claims.

I claim:

1. An auxiliary support device including a swivel assembly for use in combination with a drum and a marching drum carrier to effect drum rotation, the auxiliary support device comprising:

a swiveling link comprising a first and a second mounting surface, where the surfaces may spin freely with respect to each other;

a drum mounting frame for mounting the link first mounting surface to a drum;

a carrier interfacing frame anchored to the second surface of said swiveling link providing links mated to corresponding links on the drum carrier frame; and spring-actuable locking stops provided adjacent said swiveling link, said stops for enabling a user to selectively position the drum in a rotational position and prevent further drum rotation.

2. The auxiliary support device of claim 1 wherein the spring-actuable locking stops comprise first and second stop structures, the first stop structure for locking the drum in a first position, the second stop structure for temporarily holding the drum in a second position.

3. The auxiliary support device of claim 1 the carrier interfacing frame comprising opposed vertical support bars, the vertical support bars having sufficient length to support the drum with one edge thereof raised when the drum is placed on a horizontal surface where a first drum head of a two headed drum is oriented upward for play by a user, while a second drum head is facing the horizontal surface and the opposed vertical bars of the carrier interfacing frame are oriented with ends of the bars distal to the swiveling link touching the horizontal surface so that the second drum head is raised from the surface in a position suitable for proper reflexive displacement of the lower head.

4. The auxiliary support device of claim 3 wherein the vertical support bars comprise eyehooks, the eyehooks being attached to the vertical support bars at the upper end thereof to allow easy mounting to a variety of bass drum carriers.

5. The auxiliary support device of claim 3 wherein the vertical support bars include axial mounting holes, the axial mounting holes for accepting support rods of a drum carrier.

6. The auxiliary support device of claim 1 wherein said swiveling link is constructed with a turntable-type bearing, the turntable-type bearing having a bearing diameter and a bearing thickness, the bearing diameter being more than 10 times the bearing thickness.

7. The auxiliary support device of claim 1 where the locking stops comprise keystone-shaped structure said keystone-shaped structure for preventing drum movement.

8. The auxiliary support device of claim 1 where the locking stops comprise rounded detent structure, said rounded detent structure for temporarily holding the drum in a select position.

9. The auxiliary support device of claim 1 wherein the drum mounting frame mates with rod inserts of drum designs having outside-threaded lug-casing inserts tightened into the drum's lug-casings.

10. The auxiliary support device of claim 1 wherein the drum mounting frame mates with conventional drum designs.

11. The swivel-assembly auxiliary support device of claim 1 comprising a locking release arm, the locking release arm being cooperable with the locking stops.

12. The swivel-assembly auxiliary support device of claim 11 wherein the locking release arm comprises a magnetic latch.

13. A drum swivel assembly for effecting drum rotation with respect to a drum carrier, the swivel assembly comprising:

a swivel mechanism, said swivel mechanism comprising a spring-actuable lock for selectively preventing drum rotation;

a drum mounting frame for mounting said swivel mechanism to a drum; and a drum carrier mounting frame for mounting said swivel mechanism and said drum to a drum carrier the carrier mounting frame providing links to a carrier that is configured ordinarily to hold a drum in a stationary manner.

14. The drum swivel assembly of claim 13 wherein said spring-actuable lock comprises first and second stop structures, the first stop structure for locking the drum in a first position, the second stop structure for temporarily holding the drum in a second position.

15. The drum swivel assembly of claim 13 wherein the drum carrier mounting frame comprises opposed support bars, said support bars having sufficient length for raising a drum edge off of a horizontal surface when the drum is placed thereon where a first drum head of a two headed drum is oriented upward for play by a user, while a second drum head is facing the horizontal surface and the opposed vertical bars of the carrier interfacing frame are oriented with the ends of the bars distal to the swivel mechanism touching the horizontal surface so that the second drum head is raised from the supporting surface in a position suitable for proper reflexive displacement of the lower head.

16. The drum swivel assembly of claim 15 wherein the support bars comprise axial mounting holes, the axial mounting holes for accepting support rods of a drum carrier.

17. A drum assembly for enabling a user to effect drum rotation with respect to a drum carrier, the drum assembly comprising, in combination:

a drum;

a swivel mechanism, said swivel mechanism comprising a spring-actuable lock for selectively preventing drum rotation;

a drum mounting frame for mounting said swivel mechanism to said drum; and a drum carrier mounting frame for mounting said swivel mechanism the carrier mounting frame providing links to a carrier that is configured ordinarily to hold a drum in a stationary manner.

18. The drum assembly of claim 17 wherein said spring-actuable lock comprises first and second stop structures, the first stop structure for locking the drum in a first position, the second stop structure for temporarily holding the drum in a second position.

19. The drum assembly of claim 17 wherein the drum carrier mounting frame comprises opposed support bars, said support bars having sufficient length for raising a drum edge off of a horizontal surface when the drum is placed thereon where a first drum head of a two headed drum is oriented upward for play by a user, while a second drum head is facing the horizontal surface and the opposed vertical bars of the carrier interfacing frame are oriented with the ends of the bars distal to the swivel mechanism touching the horizontal surface so that the second drum head is raised from the supporting surface in a position suitable for proper reflexive displacement of the lower head.

20. The drum assembly of claim 19 wherein the support bars comprise axial mounting holes, the axial mounting holes for accepting support rods of a drum carrier.

* * * * *